United States Patent [19]

Jones

[11] 4,434,726

[45] Mar. 6, 1984

[54] FINE PARTICULATE FEED SYSTEM FOR FLUIDIZED BED FURNACE

[75] Inventor: Brian C. Jones, Windsor, Conn.

[73] Assignee: Combustion Engineering, Inc., Windsor, Conn.

[21] Appl. No.: 453,543

[22] Filed: Dec. 27, 1982

[51] Int. Cl.[3] ..... F22B 1/00

[52] U.S. Cl. ..... 110/347; 110/245

[58] Field of Search ..... 110/245, 347, 263; 122/4 D

[56] References Cited

U.S. PATENT DOCUMENTS

| | | | |
|---|---|---|---|
| 3,366,080 | 1/1968 | Albertson | 110/245 |
| 4,206,712 | 6/1980 | Vatsky | 110/264 |
| 4,259,911 | 4/1981 | Jones | 110/245 |
| 4,312,280 | 1/1982 | Shearer et al. | 110/345 |
| 4,325,327 | 4/1982 | Kantesaria et al. | 110/263 |

*Primary Examiner*—Henry C. Yuen

*Attorney, Agent, or Firm*—David L. Smith

[57] ABSTRACT

A method and apparatus for feeding solids into the bed of a fluidized bed furnace (18). The feed solids are separated into a fine fraction and a coarse fraction. The coarse fraction is supplied to fluidized bed (16) in an in-bed pneumatic transport feed system or in an over-the-bed feed system. The fine fraction as well as fluidizing air are supplied to fines admission zone (24) wherein the fine fraction and fluidizing air are thoroughly mixed. The mixture of the fine fraction of feed solids and the fludizing air is then passed upwardly through air distribution means (38) into fluidized bed (16).

14 Claims, 5 Drawing Figures

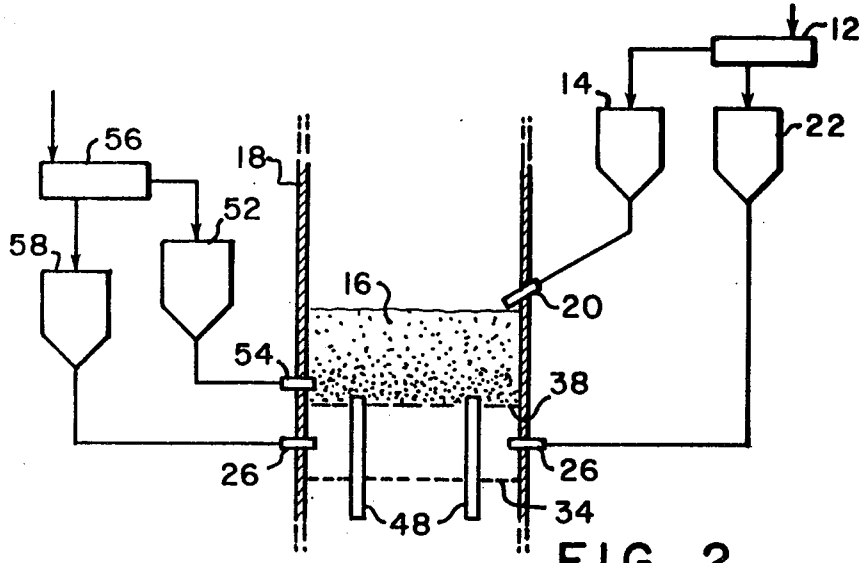
FIG. 2
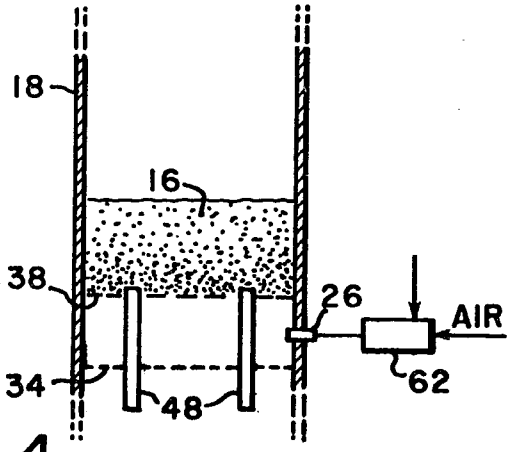
FIG. 4
FIG. 3
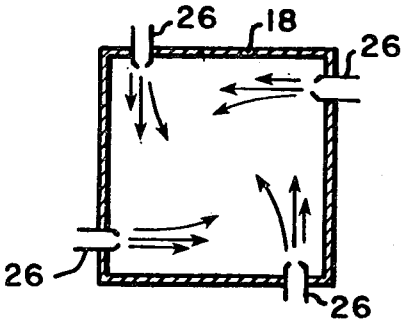
FIG. 5

FINE PARTICULATE FEED SYSTEM FOR FLUIDIZED BED FURNACE

BACKGROUND OF THE INVENTION

The present invention relates to a method and apparatus for feeding solids into the bed of a fluidized bed combustion furnace and in particular to a method and apparatus for feeding fine feed solids so as to extend the residence time of the fine feed solids in the fluidized bed.

In present fluidized bed combustion systems, the feed solids are typically discharged through nozzles or openings located in or above the fluidized bed. Combustion air serves as fluidizing air and is supplied to an air plenum located beneath the fluidized bed. The fluidizing air passes upward from the air plenum into the fluidized bed through a perforated bed support plate at a flow rate sufficiently high to fluidize the feed solids within the fluidized bed. The feed solids are comprised of sulfur oxide sorbent and sulfur containing carbonaceous fuel. Combustion occurs in the fluidized bed and in the freeboard region above the bed. The combustion flue gases exit the freeboard region through the top of the fluidized bed furnace.

In a typical fluidized bed pneumatic transport feed system, discharge nozzles are located near the bottom of the fluidized bed above the perforated bed support plate. The feed solids and pneumatic transport air are released into the bed at the discharge nozzles. The pneumatic transport air passes directly upward through the bed from the discharge nozzles, resulting in locally increased gas velocity and subsequent entrainment of fine feed solids. The fine feed solids are carried upwardly through the fluidized bed and elutriated into the freeboard region above the bed without thoroughly mixing with the fluidized feed solids within the bed. Rapid elutriation of the fine feed solids lowers the residence time of the fine feed solids in the fluidized bed. Due to inadequate mixing and reduced residence time, the fine feed solids are not completely reacted in the fluidized bed.

More thorough mixing of the fine feed solids with the fluidizing air and with the coarser feed solids in the fluidized bed would provide a longer residence time of the fine feed solids in the fluidized bed and in turn facilitate a more complete reaction.

SUMMARY OF THE INVENTION

In accordance with the present invention, the fluidized bed furnace feed solids are separated into a fine fraction and a coarse fraction. The coarse fraction is supplied to the fluidized bed in an in-bed pneumatic transport fuel system or in an over the bed feed system. The fine fraction as well as fluidizing air are supplied to a fines admission zone wherein the fine fraction and fluidizing air are thoroughly mixed. The mixture of the fine fraction of feed solids and the fluidizing air is then passed upwardly through a bed support plate into the fluidized bed.

Mixing the fine feed solids with the fluidizing air prior to supplying the fluidizing air to the fluidized bed assures thorough and uniform mixing. Furthermore, the rapid elutriation of fine feed solids due to venting of pneumatic transport air through the fluidized bed to the feedboard region above the bed is acutely reduced.

BRIEF DESCRIPTION OF THE DRAWING

FIG. 2 is a fractional representation of the fluidized bed system of FIG. 1 disclosing an alternate embodiment;

FIG. 3 is a tractional representation of the fluidized bed system of FIG. 1 disclosing an alternate embodiment;

FIG. 4 is a fractional representation of the fluidized bed system of FIG. 1 disclosing an alternate embodiment; and FIG. 5 is a cross-section of the fines admission zone taken along the lines 5—5 in FIG. 1 illustrating tangential injection of the fine feed solids.

DESCRIPTION OF THE PREFERRED EMBODIMENT

Figure 1:
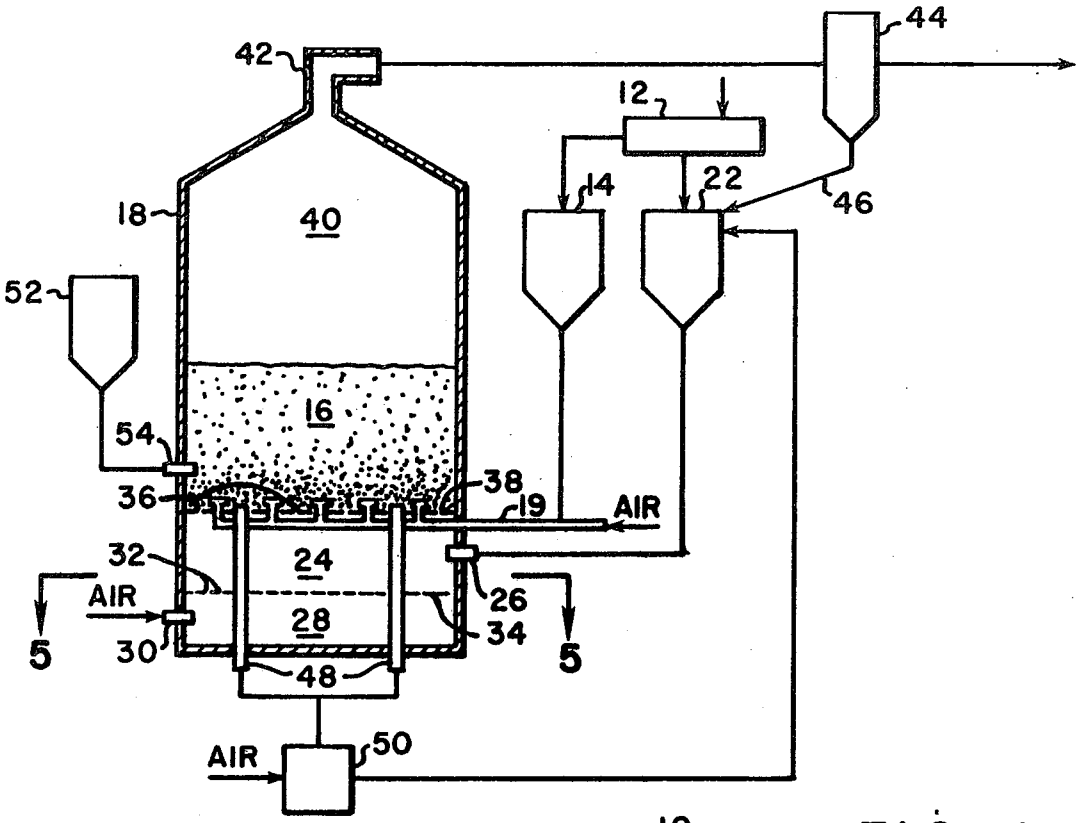
FIG. 1 is a diagrammatic representation of a fluidized bed system incorporating fine feed solids mixing with the fluidizing air prior to the mixture being supplied to the fluidized bed in accordance with the present invention.

Referring to the drawing, there is depicted a fluidized bed system 10 in accordance with the present invention as best seen in FIG. 1. In fluidized bed furnace 18, fluidized bed chamber 16 is located beneath freeboard region 40. The chamber of furnace 18 is divided into a combustion region above bed support plate 38 and a fluidizing air inlet region below bed support plate 38. The fluidizing air inlet region is further divided into a fines admission zone 24 above and an air inlet zone 28 below perforated grid plate 34. Crushed sulfur containing carbonaceous fuel is separated by separation means 12, such as a 50 mesh screen, into a coarse fuel fraction and a finel fuel fraction. The fuel in the preferred embodiment is coal. It is understood that sulfur containing carbonaceous fuel includes coal, petroleum coke and anthracite culm. The coarse coal fraction may be temporarily stored in bin 14 until it is supplied to fluidized bed 16 within furnace 18 through pneumatic transport feed system 19 or alternatively as shown in FIG. 2 through an overbed feeding nozzle 20 in an overbed fuel feed arrangement.

The fines fraction may be temporarily stored in a separate bin 22 from which it is injected into the fines admission zone 24 through nozzles 26. Fluidizing air enters air plenum 28 through inlet 30 and passes upwardly through a plurality of air ports 32 in lower perforated grid plate 34 into the fines admission zone 24. Lower perforated grid plate 34 provides a pressure drop sufficient to uniformly distribute the fluidizing air as the fluidizing air enters fines admission zone 24. The injected fine feed solids and the fluidizing air are thoroughly mixed in fines admission zone 24.

The upward velocity of the mixture of fine feed solids and fluidizing air is maintained greater than the entrainment velocity of the fine feed solids to assure that the fine feed solids are carried into the fluidized bed by the fluidizing air. Preferably, the fine feed solids are injected into fines admission zone 24 through nozzles 26 with each nozzle directed tangentially to an imaginary circle in the center of fines admission zone 24. Tangential injection of the fine feed solids is shown in FIG. 5.

The resulting mixture of fine feed solids and fluidizing air passes upwardly through air ports 36 in upper perforated grid plate 38 into fluidized bed 16. Upper perforated grid plate 38 is preferably water cooled and designed with a smaller pressure drop than lower perforated grid plate 34. Upper perforated grid plate 38 functions to support fluidized bed 16 and provide a partition between fines admission zone 24 and fluidized bed 16. The upward velocity of the mixture of fluidizing air and fine feed solids in air ports 36 is greater than the terminal velocity of the bed solids to prevent the bed solids from gravitating into fines admission zone 24 during operation of fluidized bed furnace 18.

The thorough mixing of fine feed solids and fluidizing air in fines admission zone 24 assures that the fine feed solids are uniformly distributed into fluidized bed 16. This acutely reduces elutriation of fine feed solids which would otherwise become entrained in the pneumatic transport air of an in-bed pneumatic feed system.

As the coal particles are consumed in the fluidized bed 16, their particle size decreases and they become light enough to be carried out of fluidized bed 16 into freeboard region 40. Some of the entrained coal particles will fall back into fluidized bed 16 while others will be completely consumed within freeboard region 40. The remaining small portion will be entrained in the combustion flue gas, along with other particulate matter such as fly ash, and be carried out of fluidized bed furnace 18 through gas outlet 42.

The flue gas passing through gas outlet 42 is passed through a particulate filter. The particulate filter separates entrained particulate matter from the flue gas so that the particulate matter may be recycled back into the fluidized bed furnace. Typically, a particulate filter 44, usually a cyclone separator, is disposed in the flue gas stream leaving the fluidized bed furnace 18 to remove the particulate matter entrained therein. The particulate matter, known as recycle material, is comprised of fly ash particles and the unburned carbon particles elutriated from fluidized bed 16. The separated particulate matter is recycled directly or indirectly to fluidized bed 16 through recycle line 46. The remainder of the dust collection train downstream of particulate filter 44 is not shown.

A bed drain system is provided to maintain bed height at a preselected level and to continuously or periodically purge the bed of any unnecessary material such as coal ash particles and spent sulfur oxide sorbent. A plurality of bed drain pipes 48 pass through or around fines admission zone 24 and air plenum 28. Bed drain pipes 48 extend upwardly into fluidized bed 16 thereby providing a flow passage communicating between fluidized bed 16 and the outside of fluidized bed furnace 18 through which the bed drain material can be removed. The bed drain material removed through bed drain pipes 48 consists of coal ash particles, spent sulfur oxide sorbent, unreacted sulfur oxide sorbent and some unburned carbon particles. The bed drain material can be disposed of as waste or comminuted in pulverizer 50 as disclosed in U.S. Pat. No. 4,329,324 and reinjected into fines admission zone 24. The comminuted bed drain material is shown in FIG. 1 as being mixed with the fine fraction of fuel in bin 22 prior to reinjection into fines admission zone 24.

The sulfur oxide sorbent may be injected into fluidized bed 16 from bin 52 through nozzle 54. In an alternate embodiment shown in FIG. 2, crushed sulfur oxide sorbent is separated by separation means 56 into a coarse fraction and a fine fraction. The coarse limestone sorbent fraction may be temporarily stored in bin 52 until it is injected into fluidized bed 16 through nozzle 54. The fine limestone sorbent fraction may be temporarily stored in bin 58 from which it is injected into fines admission zone 24 through nozzles 26.

In an alternate embodiment shown in FIG. 3, the sulfur oxide sorbent is pulverized in pulverizer 60, then temporarily stored in bin 58 from which it is injected into fines admission zone 24 through nozzles 26.

Combustion can be prevented in fines admission zone 24 by maintaining the suspended fine coal concentration below the minimum level required for combustion. The fine fraction of coal is typically less than 20% of the total coal feed and is highly reactive due to its small particle size. Maintaining the corresponding coal concentration in the fines admission zone less than 0.025 $kg/m^3$ (0.025 oz./cu.ft.) assures that combustion will not occur in the fines admission zone even though the gas temperature will typically range from 232° C. to 288° C. (450° F. to 550° F.) because the coal concentration is below the lower ignition limit of about 0.06 $kg/m^3$ (0.06 oz./cu.ft.) required to sustain combustion.

Alternatively, combustion can be suppressed in fines admission zone 24 by mixing inert solids with the fine coal particles and fluidizing air. This can be accomplished by premixing inert material such as recycle material, pulverized bed drain solids or pulverized sulfur oxide sorbent with the fines fraction prior to injecting the mixture into fines admission zone 24.

One particular application of the invention is to fire exclusively pulverized coal as the fine particulate material as shown in FIG. 4 wherein the coal is pulverized in pulverizer 62 before being injected into fines admission zone 24 through nozzles 26. When firing pulverized coal, the coarse fraction is comprised of primarily sulfur oxide sorbent. Combustion suppression in fines admission zone 24 is achieved by mixing inert solids with the pulverized coal. In continuous operation an inert concentration of about 0.40 $kg/m^3$ (0.40 oz./cu.ft.) can be attained based on typical bed drain and recycle rates in fluidized bed furnaces. The inert concentration available exceeds the experimental and field data minimum inert concentrations of 0.20 $kg/m^3$ (20 oz./cu.ft.) required to prevent combustion of typical stoichiometric mixtures of pulverized coal and air.

Pulverized coal when introduced uniformly across the bottom of fluidized bed 16 will burn out more completely and more uniformly than crushed coal in an in-bed pneumatic transport feed system or in an over the bed feed system thereby increasing combustion efficiency. Injecting pulverized coal into the fines admission zone 24 obviates the need for the pneumatic transport line penetrating fluidized bed 16 thereby eliminating gas bypassing. Gas bypassing is caused when fluidizing air passing upwardly through perforated grid plate 38 combines with the pneumatic transport air released at the coal feed nozzles and the mixture passes rapidly up through fluidized bed 16.

During a controlled shutdown of the fluidized bed furnace, fines injection is terminated prior to termination of fluidizing air flow to allow the bed to cool off. Upon termination of fluidizing air flow, the bed solids fall onto upper perforated grid plate 38 with a portion of the bed solids gravitating through air ports 36 and falling onto lower perforated grid plate 34. The fines admission zone 24 is purged of most of the bed solids during startup. This is accomplished by increasing the fluidizing air flow sufficiently to refluidize the slumped bed and carry any portion of the slumped bed that gravitated into fines admission zone 24 up through air ports 36 into fluidized bed 16 prior to injection of fine solids into fines admission zone 24.

It is contemplated within the invention that the fuel may be separated into a coarse fraction and/or a fine fraction or that the sulfur oxide sorbent may be separated into a coarse fraction and/or a fine fraction or any combination thereof. It is also contemplated within the invention that the fine fraction of fuel or the fine fraction of sulfur dioxide sorbent may be pulverized.

I claim:

1. In a fluidized bed furnace of the type having a furnace chamber with an air distributor plate extending transversely across the chamber dividing the chamber into a combustion zone in which the fluidized bed, once established, is confined above the air distributor plate and an air inlet zone below the air distributor plate, a method of introducing particulate feed solids including both a coarse fraction and a fine fraction into the fluidized bed furnace, comprising the steps of:

(a) passing the coarse fraction directly to the combustion zone;
(b) establishing a flow of fluidizing air up through the air distributor plate and combustion zone;
(c) passing the fine fraction to the air inlet zone;
(d) mixing the fine fraction with the fluidizing air in the air inlet zone; and
(e) passing the mixture of the fine fraction and fluidizing air up through the air distributor plate thence up through the the fluidized bed.

2. A method of introducing particulate feed solids into a fluidized bed furnace as recited in claim 1 wherein the step of mixing the fine fraction with the fluidizing air comprises introducing the fine feed solids into the fluidizing air in a plurality of streams with each stream directed tangentially to an imaginary circle.

3. A method of introducing particulate feed solids into a fluidized bed furnace as recited in claim 1 wherein the feed solids comprise crushed coal.

4. A method of introducing particulate feed solids into a fluidized bed furnace as recited in claim 1 wherein the feed solids comprise crushed coal and limestone.

5. A method of introducing particulate feed solids into a fluidized bed furnace as recited in claim 1 wherein the fine fraction comprises pulverized coal and the coarse fraction comprises limestone.

6. A method of introducing particulate feed solids into a fluidized bed furnace as recited in claim 1 wherein the fine fraction is a particular material from the group consisting essentially of pulverized coal, pulverized limestone, recycle material, pulverized bed drain material and mixtures thereof.

7. A method of introducing particulate feed solids into a fluidized bed furnace as recited in claim 1 further comprising maintaining the upward velocity of the mixture of fine feed solids and fluidizing air greater than the entrainment velocity of the fine feed solids.

8. In a fluidized bed furnace of the type having a furnace chamber with an air distributor plate extending transversely across the chamber dividing the chamber into a combustion zone in which the fluidized bed, once established, is confined above the air distributor plate and an air inlet zone below the air distributor plate a method of introducing particulate feed solids into the fluidized bed furnace, comprising the steps of:

(a) separating the feed solids into a fine fraction and a coarse fraction;
(b) passing the coarse fraction directly to the combustion zone;
(c) establishing a flow of fluidizing air up through the air distributor plate and combustion zone;
(d) passing the fine fraction to the air inlet zone;
(e) mixing the fine fraction with the fluidizing air in the air inlet zone; and
(f) passing the mixture of the fine fraction and fluidizing air up through the air distributor plate thence up through the fluidized bed.

9. A method of introducing particulate feed solids into a fluidized bed furnace as recited in claim 8 wherein the step of mixing the fine fraction with the fluidizing air comprises introducing the fine feed solids into the fluidizing air in a plurality of streams with each stream directed tangentially to an imaginary circle.

10. A method of introducing particulate feed solids into a fluidized bed furnace as recited in claim 8 wherein the feed solids comprise crushed coal.

11. A method of introducing particulate feed solids into a fluidized bed furnace as recited in claim 8 wherein the feed solids comprise crushed coal and limestone.

12. A method of introducing particulate feed solids into a fluidized bed furnace as recited in claim 8 wherein the fine fraction comprises pulverized coal and the coarse fraction comprises limestone.

13. A method of introducing particulate feed solids into a fluidized bed furnace as recited in claim 8 wherein the fine fraction is a particular material from the group consisting essentially of pulverized coal, pulverized limestone, recycle material, pulverized bed drain material and mixtures thereof.

14. A method of introducing particulate feed solids into a fluidized bed furnace as recited in claim 8 further comprising maintaining the upward velocity of the mixture of fine feed solids and fluidizing air greater than the entrainment velocity of the fine feed solids.

* * * * *